US008561338B2

(12) United States Patent
Chvala

(10) Patent No.: US 8,561,338 B2
(45) Date of Patent: Oct. 22, 2013

(54) PISTOL GRIP RECOIL ASSEMBLY FOR FIREARMS

(75) Inventor: John R. Chvala, Grafton, WI (US)

(73) Assignee: Advanced Technology International USA, LLC, Milwaukee, WI (US)

( * ) Notice: Subject to any disclaimer, the term of this patent is extended or adjusted under 35 U.S.C. 154(b) by 233 days.

(21) Appl. No.: 13/037,525

(22) Filed: Mar. 1, 2011

(65) Prior Publication Data

US 2012/0222342 A1 Sep. 6, 2012

(51) Int. Cl.
*F41C 23/00* (2006.01)

(52) U.S. Cl.
USPC ..... 42/74; 42/71.02; 16/430; 16/436

(58) Field of Classification Search
USPC ..... 42/1.06, 7, 71.02, 74; 16/436, 489, 430
See application file for complete search history.

(56) References Cited

U.S. PATENT DOCUMENTS

| | | | | |
|---|---|---|---|---|
| D257,166 | S | 9/1980 | Hogue | |
| D271,229 | S | 11/1983 | Pachmayr et al. | |
| D306,636 | S | 3/1990 | Cox | |
| 4,936,036 | A * | 6/1990 | Sniezak et al. | 42/71.02 |
| D335,698 | S | 5/1993 | Lett, Jr. | |
| D374,903 | S | 10/1996 | Pearce | |
| D377,304 | S | 1/1997 | Hogue et al. | |
| 5,621,997 | A | 4/1997 | Pearce | |
| D382,458 | S | 8/1997 | Hogue et al. | |
| D393,194 | S | 4/1998 | Hogue et al. | |
| D410,988 | S | 6/1999 | Hines | |
| D479,571 | S | 9/2003 | Benini | |
| D559,345 | S | 1/2008 | Wayne | |
| D562,931 | S | 2/2008 | Szabo | |
| 8,156,677 | B2 * | 4/2012 | Glock | 42/71.02 |

* cited by examiner

*Primary Examiner* — Daniel J Troy
(74) *Attorney, Agent, or Firm* — Andrus, Sceales, Starke & Sawall, LLP

(57) ABSTRACT

A pistol grip recoil assembly for a firearm includes a rigid grip body formed with rest structure thereon and connected to a firearm. A substantially elastomeric, resilient and deformable grip insert is received in the grip body and forms a shock absorbing, cushioning backstrap engageable with the palm of a user's hand for minimizing recoil caused by discharge of the firearm. The grip body and grip insert are slidably engaged together by means of a dovetail arrangement and secured together thereafter by a means of a fastening structure.

15 Claims, 7 Drawing Sheets

PISTOL GRIP RECOIL ASSEMBLY FOR FIREARMS

BACKGROUND

The present disclosure relates generally to firearms such as shotguns and rifles and, more particularly, pertains to a hand grip or pistol grip recoil assembly for such firearms.

One age old problem that exists with firearms is the fact that they have a severe reactive kicking force or recoil that affects the person firing the weapon. In firearms, such as shotguns and rifles, it is common practice to replace the gun's stock with a pistol grip that shortens the length of the gun and makes it easier to handle and control. However, when firing weapons with a pistol grip, recoil commonly causes the shooter to involuntarily lift the front of the muzzle of the firearm each time the weapon is fired resulting in pain to the hand of the shooter. Such recoil-induced muzzle lift challenges the shooter to reacquire a target and thereby affects the shooter's performance.

Various known pistol grip assemblies, such as those that employ spring and pistol-type recoil suppression systems therein, have not proven to be particularly cost effective, and do not satisfactorily absorb the felt punch of the recoil as they continue to transfer shock energy to the shooter's hand.

Accordingly, it remains desirable to provide a firearm with a pistol grip recoil assembly which is of a relatively simple, affordable construction that more effectively absorbs the energy wave of recoil regardless of load size, so as to increase the shooter's comfort while reducing muzzle lift. It is also desirable to provide a lightweight, rugged and functional pistol grip recoil assembly that enables a shooter to have confidence and tactical advantage without fatigue and pain.

SUMMARY

The present disclosure relates to a pistol grip recoil assembly including a grip body constructed of rigid material, formed with finger rest structure and adapted to be connected to a device operated to produce a recoil force. A grip insert is received in the grip body and has a resilient, deformable backstrap constructed of an elastomeric, shock absorbing and cushioning material adapted to be engaged by a palm of a user's hand for minimizing the recoil force caused by operation of the device.

The grip body has a curved outer surface formed with the finger rest structure, and a recessed inner surface defining a slide track for removably mounting the grip insert therein. The grip body includes a connector adapted to connect the grip body to the device producing the recoil force. The backstrap includes an elastomeric spine that is attached to a rigid reinforcing member. The rigid reinforcing member has side edges that are matingly received in the slide track of the grip body.

The present disclosure further relates to a pistol grip recoil assembly for a firearm including a rigid grip body formed with finger rest structure thereon and connected to a firearm. A substantially elastomeric, resilient and deformable grip insert is received in the grip body forming a shock absorbing, cushioning backstrap engageable with the palm of a user's hand for minimizing recoil caused by discharge of the firearm. The grip body and grip insert are slidably engaged together by means of a dovetail arrangement and secured together thereafter by means of a fastening structure.

The grip body includes a curved forward facing outer surface provided with multiple spaced apart ribs that form the finger rest structure therebetween. The grip body has a top end provided with a connector enabling attachment of the grip body to the firearm. The grip body has a pair of spaced apart rear walls that are connected together by a bridge portion, and merge smoothly into a bottom end of the grip body. The grip body also includes a recessed inner surface formed with a pair of opposed longitudinally extending and inwardly projecting cylindrical tubes provided with holes on bottom ends thereof. The inner surface further includes a pair of opposed longitudinally extending notches that define a slide track for receiving the grip insert. Each notch includes a forward segment, a side segment, a rear segment and an angled segment connecting the forward and side segments.

The backstrap includes an elastomeric spine that is attached to a rigid reinforcing member preferably constructed of a hard plastic material. The reinforcing member has opposed side edges, each of which includes a forward wall segment, a side wall segment, a rear wall segment and an angled wall segment connecting the forward wall segment and the side wall segment. The reinforcing member of the grip insert and the notches of the grip body have cooperating engagement surfaces which define the dovetail arrangement. The backstrap has a curved outer surface formed with a grip enhancing structure. The backstrap includes a base formed with apertures that are alignable with the holes of the cylindrical tubes. The apertures and holes are configured to receive the fastening structure for securing the grip body and the grip insert together. The grip insert is removable from the grip body while the grip body is connected to the firearm.

The present disclosure further contemplates a method of assembling a pistol grip comprising the steps of a) providing a rigid grip body formed with finger rest structure thereon; b) providing a substantially elastomeric, resilient, deformable grip insert having a shock absorbing, cushioning backstrap adapted to be engaged with the palm of a user's hand; c) slidably engaging the grip body and the grip insert together by means of a dovetail arrangement; and d) securing the grip body and grip insert together using a fastener structure once the grip body and the grip insert are in slidable engagement with each other.

The step of providing the grip body includes molding the grip body with slide track structure. The step of providing the grip insert includes the step of molding the backstrap with a spine and a rigid reinforcing member that is engageable in the slide track structure.

BRIEF DESCRIPTION OF THE DRAWINGS

The drawings illustrate the best mode presently contemplated of carrying out the disclosure. In the drawings.

DETAILED DESCRIPTION

Figure 1:
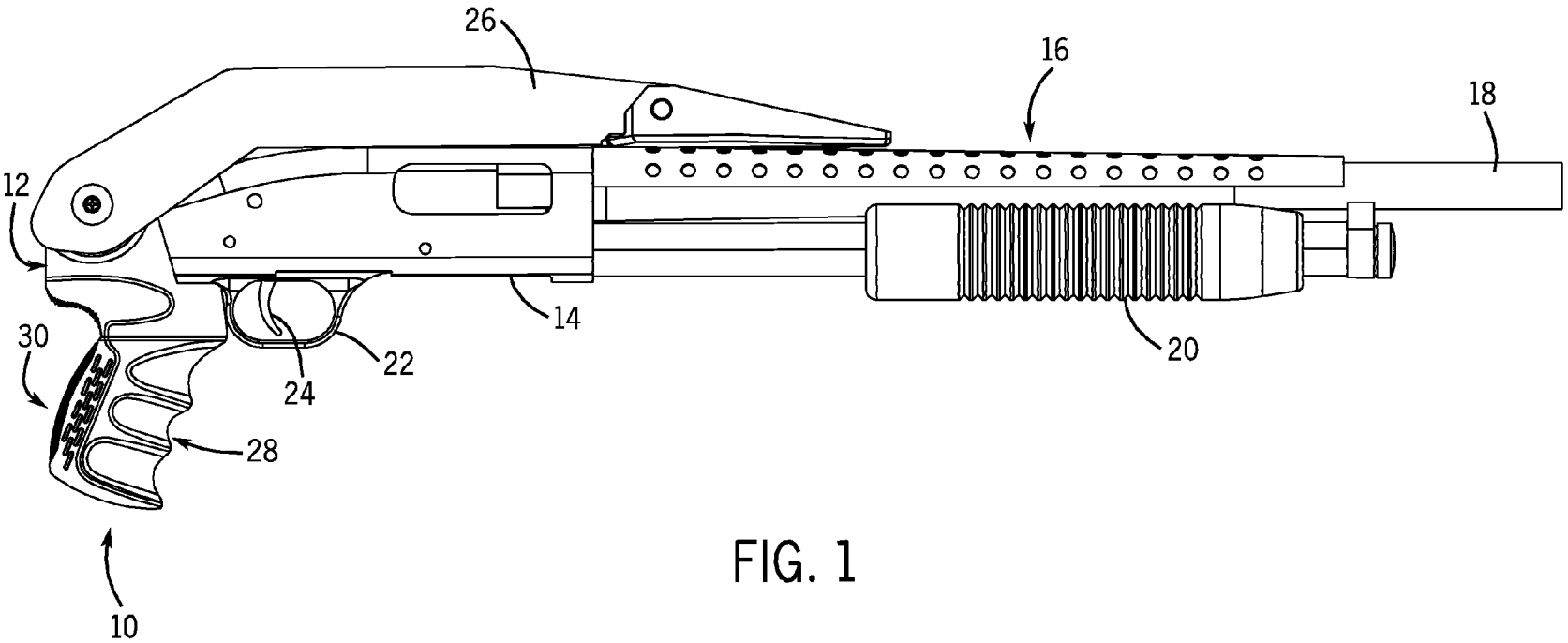
FIG. 1 is an elevational view of a shotgun provided with a pistol grip recoil assembly in accordance with the present disclosure.
Figure 2:
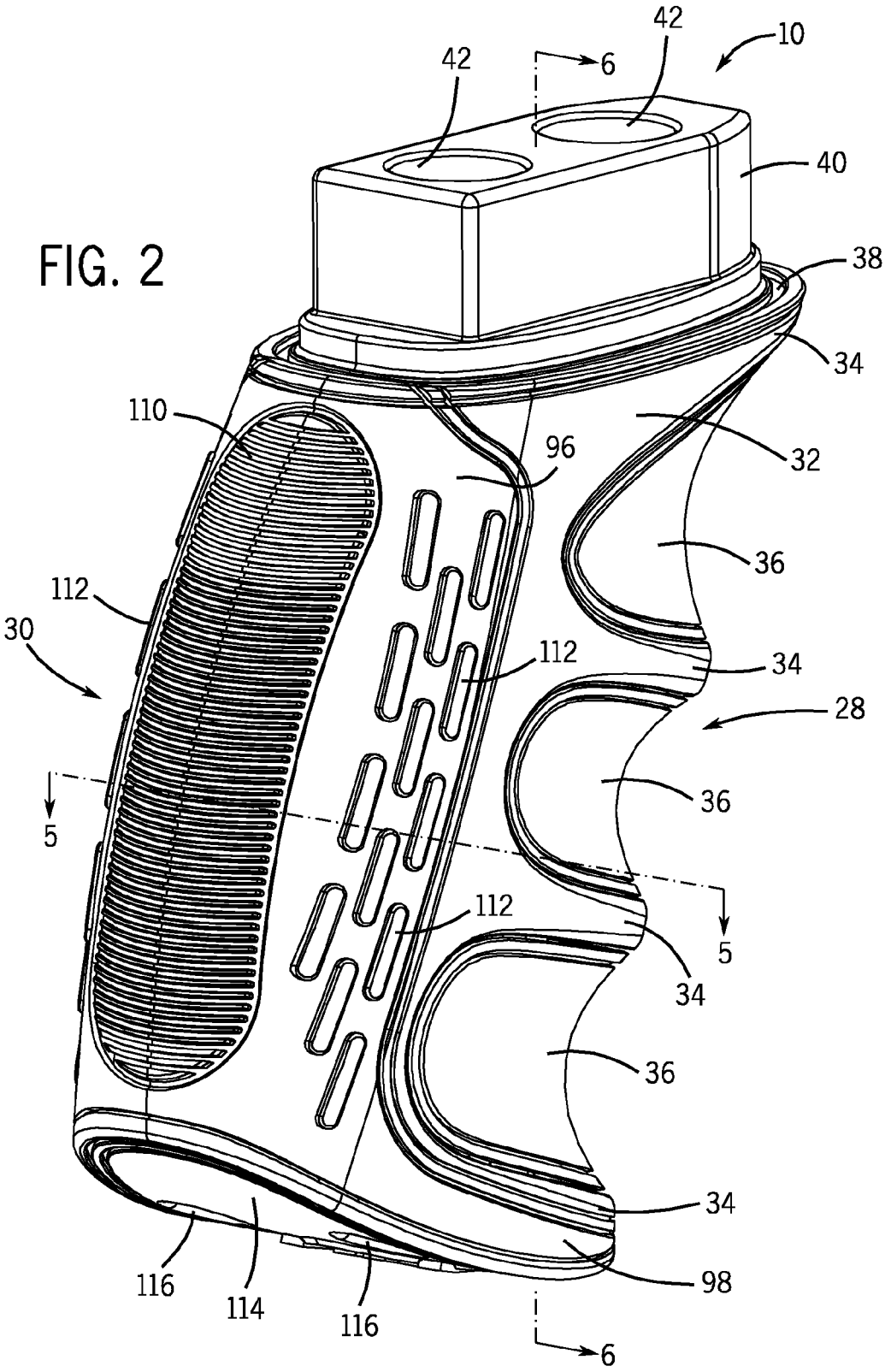
FIG. 2 is an enlarged rear perspective view of the pistol grip recoil assembly of FIG. 1 removed from the shotgun.
Figure 3:
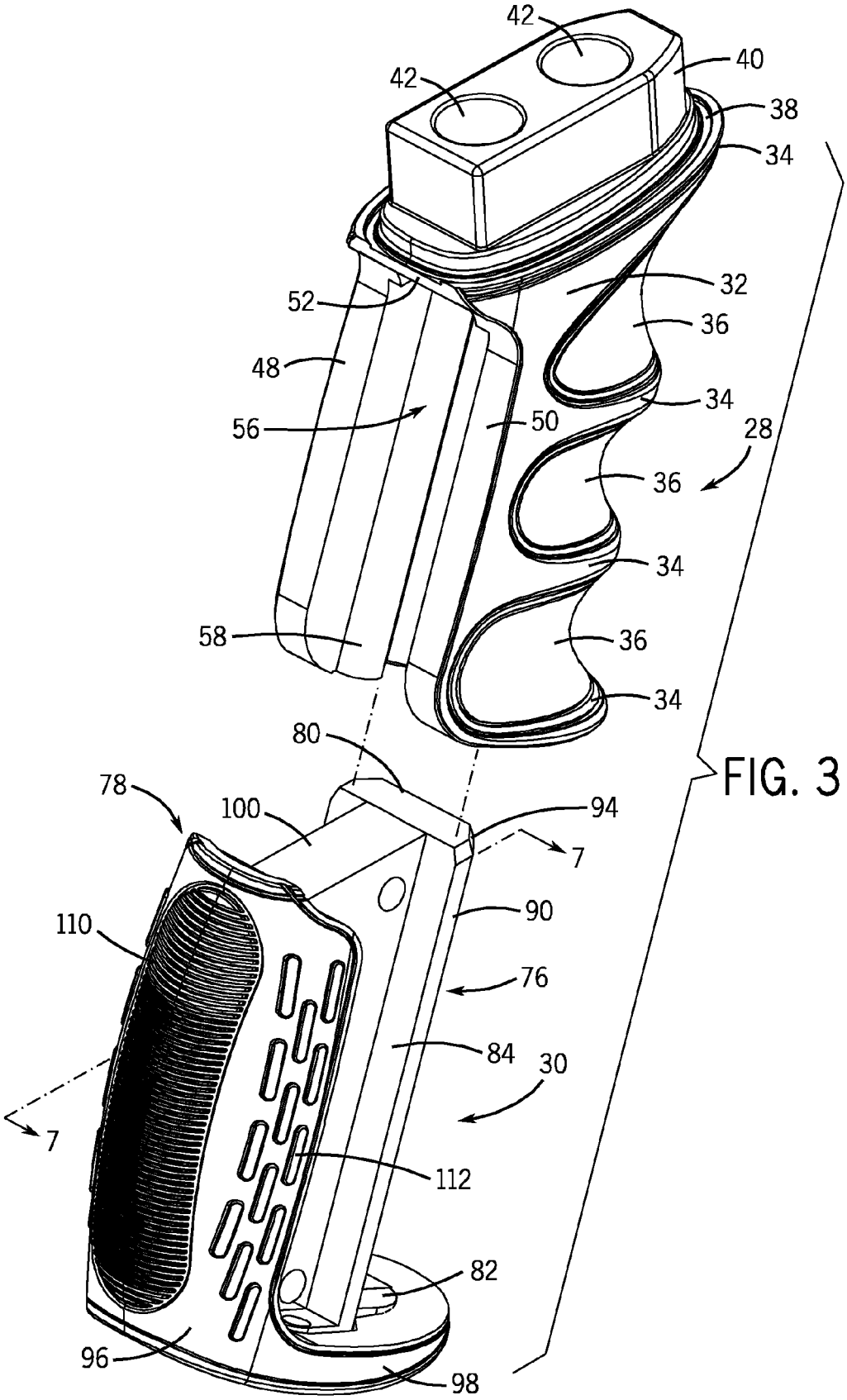
FIG. 3 is an exploded view of FIG. 2.

Referring now to the drawings, FIG. 1 illustrates a pistol grip recoil assembly 10 detachably secured via a mounting device 12 to a rear end of a receiver 14 of a firearm, such as a rifle or shotgun 16. The firearm 16 includes a barrel 18, a gripping forend 20, a trigger guard 22 and a trigger 24. The exemplary firearm 16 shown also includes an over the top stock 26 that can be folded from a retracted position over the receiver 14 and barrel 18 to an extended position for engagement with a shooter's shoulder.

The pistol grip recoil assembly 10 embodying the present invention is comprised substantially of two major pieces, namely a main grip body 28 and a grip insert 30 which is slidably received and retained within the grip body 28. The pistol grip assembly 10 is designed to enable a user or shooter to better hold and aim the firearm 16, to reduce recoil and to otherwise improve the comfort with which the firearm 16 is held and fired.

As seen in FIGS. 2-6, the grip body 28 is formed typically, by molding, of a rigid material preferably constructed of an extreme temperature resistant, glass reinforced polymer having sufficient strength and rigidity to maintain its illustrated shape without deformation under all conditions of use of the firearm 16. The rigid grip body 28 includes a curved and forwardly facing outer surface 32 provided with multiple spaced apart curved ribs 34 that project forwardly form the outer surface 32 and form therebetween a number of proportioned grooves 36 that define a finger rest structure for the shooter's fingers. The finger rest structure may be varied according to the size and style of the gun, and may include a surface finish or texture as desired for improving a shooter's grip.

A top end 38 of the grip body 28 is integrally formed with an upwardly extending connector 40 which is configured to be received and retained within the mounting device 12 at the rear of the firearm receiver 14. The connector 40 is molded with a pair of cylindrical chambers 42 that communicate with a pair of recesses 44, 46 (FIG. 6) for receiving suitable retaining fasteners therein. The outer surface 32 has a pair of spaced apart, longitudinally extending rear walls 48, 50 that are connected by a bridge portion 52 at the top end 38. The rear walls 48, 50 extend downwardly from bridge portion 52, and smoothly merge into a bottom end 54 lying beneath the lowermost rib 34 as clearly shown in FIG. 4.

The grip body 28 further includes a recessed inner surface 56 which is specially configured to slidably receive the grip insert 30. As variously depicted in FIGS. 3-5, the inner surface 56 includes a pair of opposed, inwardly extending cylindrical tubes 58, 60 (FIGS. 4, 5) that extend substantially continuously from the top end 38 to the bottom end 54. Bottom ends of the tubes 58, 60 are provided with holes 62 for receiving fasteners 64 that positively secure the grip body 28 and grip 30 together. Opposite sides of the inner surface 56 are formed with notches 66 that extend longitudinally between the top end 38 and the bottom end 54, and define a slide track for receiving the grip insert 30. Each notch 66 includes a forward segment 68, a side segment 70, a rear segment 72 and an angled segment 74 connecting the forward and side segments 68, 70, respectively.

Figure 4:
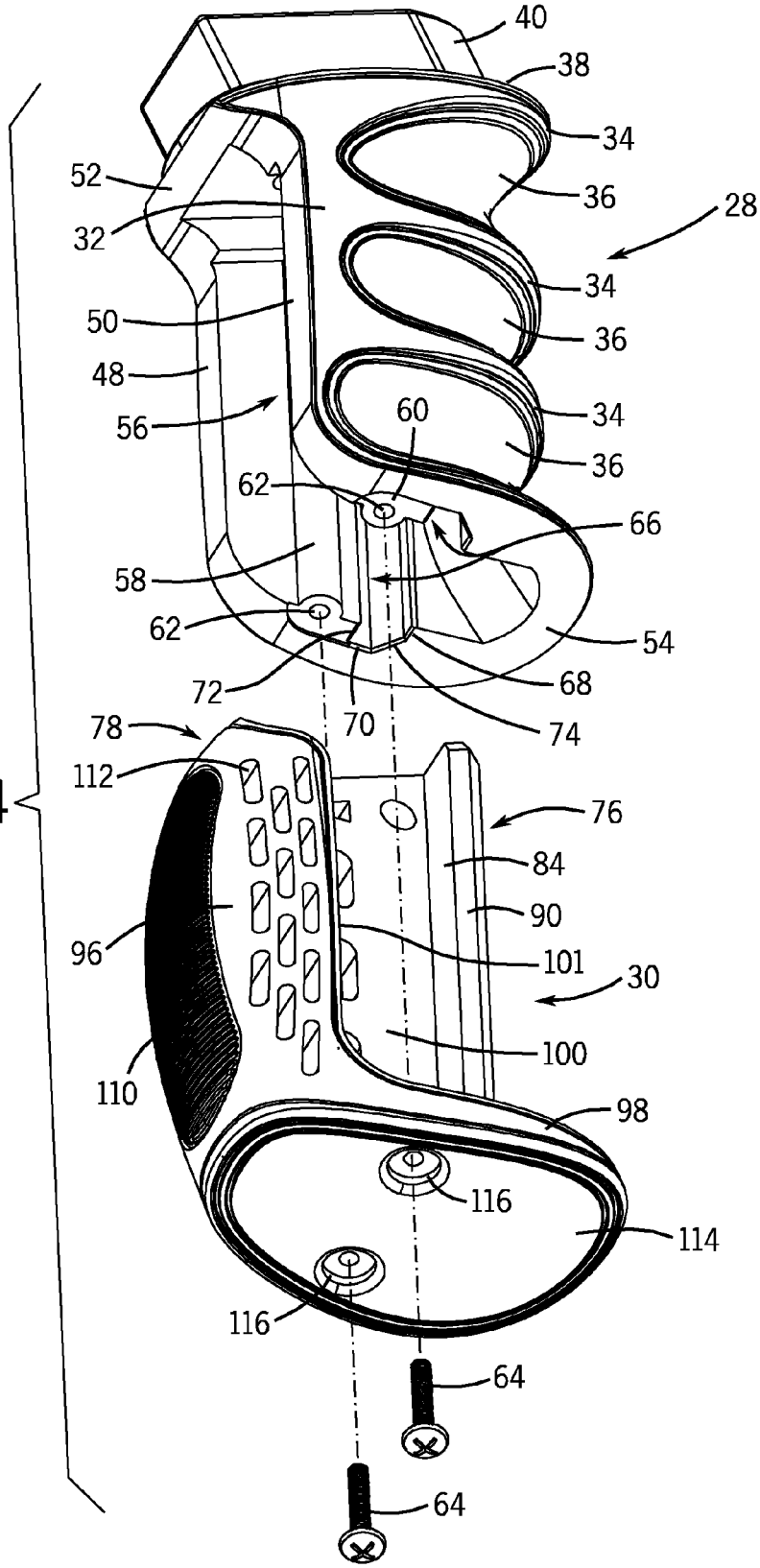
FIG. 4 is an exploded view taken from the bottom of FIG. 3 showing fasteners used in the pistol grip recoil assembly.
Figure 5:
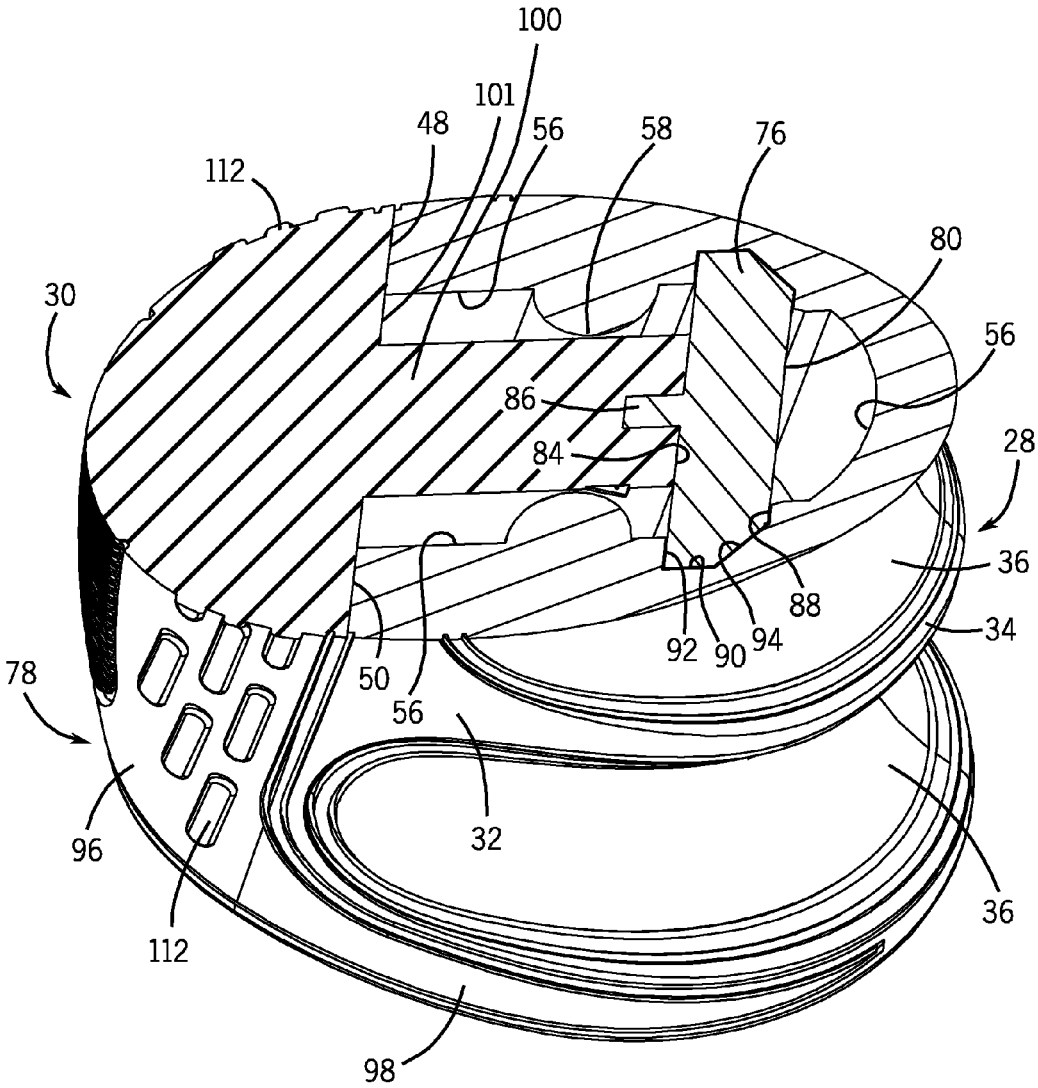
FIG. 5 is a sectional view taken on line 5-5 of FIG. 2.

As best seen in FIGS. 3-7, the grip insert 30 is formed typically by co-molding a rigid vertically extending reinforcing member 76 preferably constructed of a hard plastic with a resilient and deformable backstrap 78 preferably constructed of an elastomeric or rubber-like, shock absorbing and cushioning material. As is well known in the firearm art, the backstrap 78 of a pistol grip is designed to be engaged by a palm of a shooter's hand during operation of the firearm 16. The reinforcing member 76 has a front wall 80 (FIG. 7) that extends downwardly to a foot portion 82, and a rear wall 84 provided with a number of tenons or projections 86. The reinforcing member 76 has opposed side edges which are configured to matingly slide within the notches 66 of the grip body 28. Referring to FIG. 5, each side edge is defined by a forward wall segment 80, a side wall segment 90, a rear wall segment 92 and an angled or beveled wall segment 94 connecting the forward wall segment 88 and the side wall segment 90. The side edges of the reinforcing member 76 and the notches 66 of the grip body 28 have cooperating engagement surfaces, and form a tongue-in-groove or dovetail locking arrangement when the reinforcing member 76 is slidably inserted into the bottom end 54 of the grip body 28 for upward movement in the walls forming notches 66.

Figure 6:
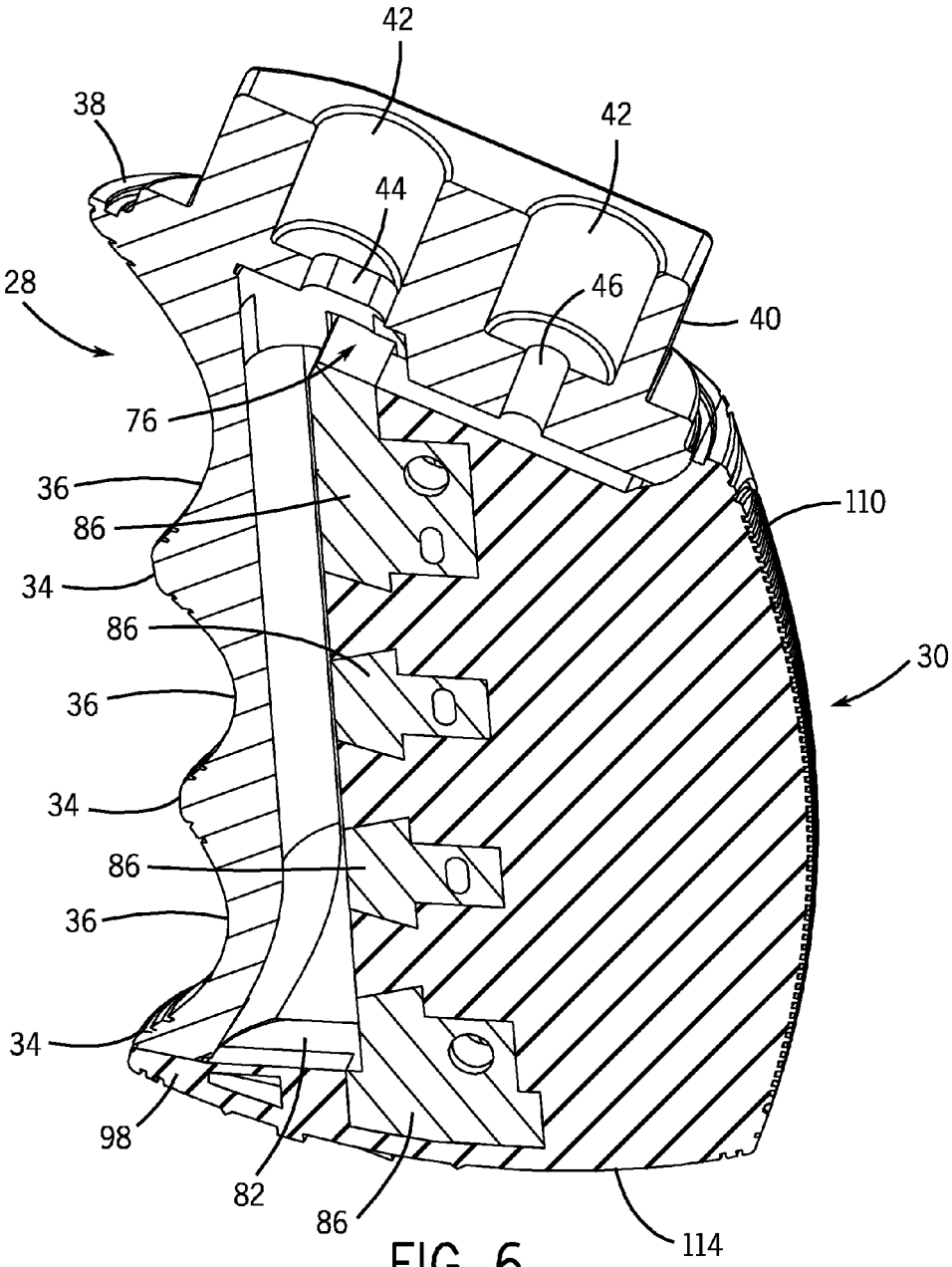
FIG. 6 is a longitudinal sectional view taken through the middle of FIG. 2 as represented by line 6-6 thereof.
Figure 7:
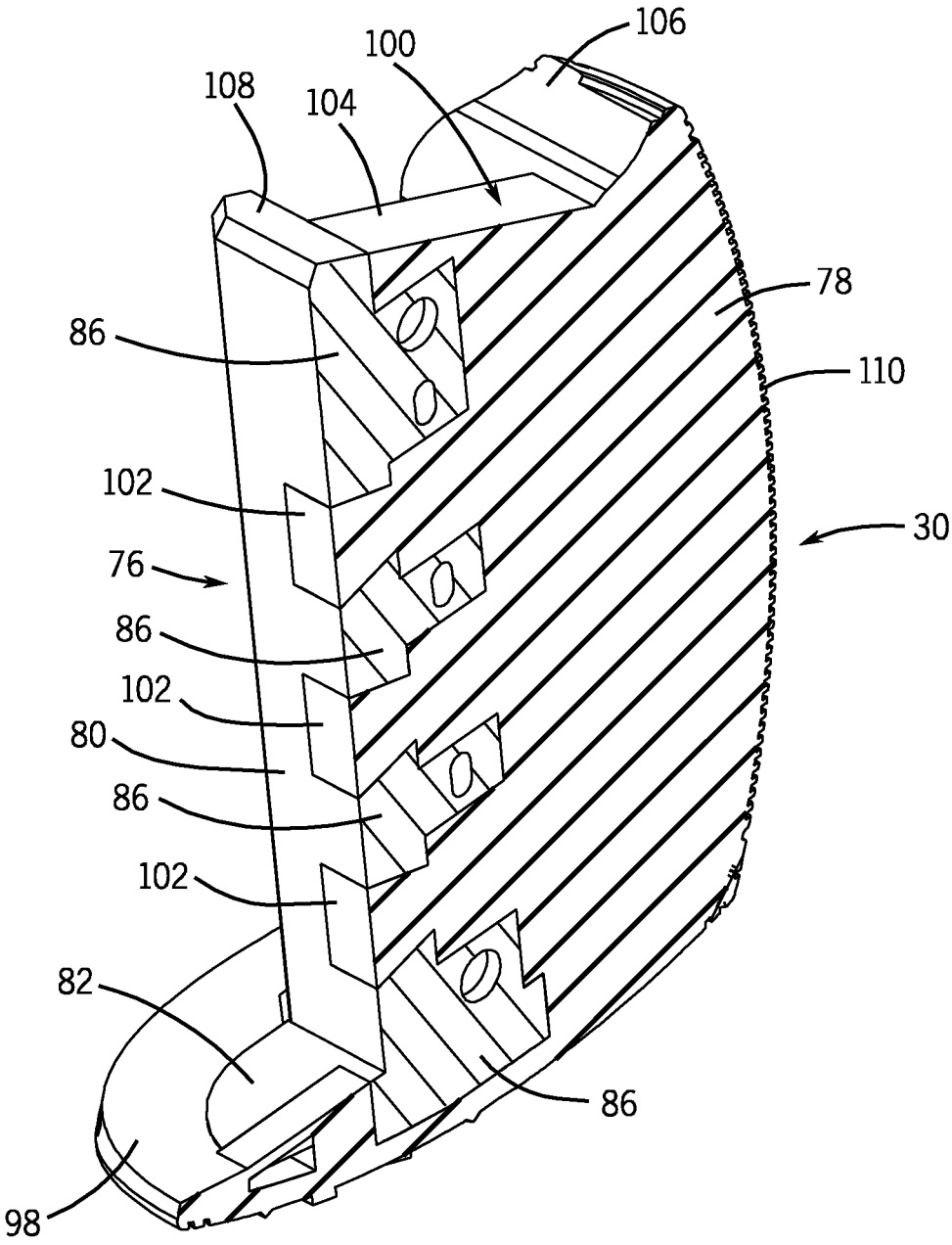
FIG. 7 is a sectional view taken on line 7-7 of FIG. 3.

The elastomeric backstrap 78 includes a curved rearwardly facing, compressible outer wall 96 which is integrally formed with a forwardly extending deformable base 98 and a forwardly extending resilient, elastomeric spine 100 that extends centrally from a front surface 101 (FIG. 5), and is continuously molded around the projections 86 of reinforcing member illustrated in FIGS. 6 and 7. The spine 100 extends transversely to the rear wall 84 of the reinforcing member 76, and has several portions 102 which extend through and lie flush with the front wall 80. The spine 100 has a sloped upper surface 104 that extends between a top edge 106 of outer wall 96 and an upper end 108 of reinforcing member 76. Base 98 is continuously molded around the lowermost projection 86 and the foot portion 82 of the reinforcing member 76. A rear portion of the outer wall 96 is formed with a series of grooves 110, and opposite side portions of the outer wall 96 are provided with staggered, vertically extending projections 112. The grooves 110 and the projections 112 function as grip enhancing surfaces for the shooter's hand. As seen in FIG. 4, the base 98 has a lowermost surface 114 formed with a pair of recessed apertures 116 that are alignable with the holes 62 in the bottom ends of the cylindrical tubes 58, 60 and are designed to receive the fasteners 64.

To form the pistol grip recoil assembly 10, the side edges of the reinforcing member 76 of grip insert 30 are aligned with the notches 66 at the bottom end 54 of grip body 28 as depicted in FIG. 4. The grip insert 30 is then moved upwardly in sliding fashion longitudinally along the walls of the notches 66 until the top edge 106 of backstrap 78 abuts the bridge portion 52 at the top end 38 of grip body 28. During the assembly, the rear walls 48, 50 of grip body 28 slide along the elastomeric front surface 101 of grip insert 30 with a progressively snug fit while the spine 100 moves between the cylindrical tubes 58, 60. With the bottom end 54 of grip body 28 engaged against the base 98 of grip insert 30, fasteners 64 are passed through the apertures 116 and screwthreaded into the holes 62 in the tubes 58, 60 of grip body 28. The assembly 10 can then be coupled to the mounting device 12 on firearm 16. It should be appreciated that, if desired, the grip insert 30 may be replaced while the grip body 28 is coupled to the firearm simply by removing fasteners 64 and sliding the insert 30 out of the grip body 28 after which a new insert 30 may be quickly and easily installed as described above.

The deformable outer wall 96 assures an effective relatively high friction but cushioned contact of the shooter's hand with the grip. When the firearm 16 is discharged, the recoiling force supplied rearwardly through the receiver 14 causes compression of the deformable spine 100 and the outer wall 96 to absorb a majority of the shock energy and prevent its transmission to the shooter's hand. The result is a substantial reduction in any discomfort or pain which might otherwise be caused by the recoiling force. The effective absorption of the recoil force minimizes the muzzle lift of the firearm 16 so that the shooter's target can quickly be reacquired. The pistol grip assembly 10 of the present disclosure has been found to be a simplified, cost effective construction when compared to other known pistol grip recoil designs, and operates consistently not being effected by chemicals, varying load size or extreme temperatures.

While the present disclosure describes the exemplary pistol grip recoil assembly 10 as being used with a firearm, it should be fully appreciated that a hand grip recoil assembly having the same construction as the pistol grip recoil assembly 10 could also be used on other devices producing recoil forces, such as a high impact tool.

Various alternatives are contemplated as being within the scope of the following claims particularly pointing out and distinctly claiming the subject matter regarded as the invention.

What is claimed is:

1. A pistol grip recoil assembly comprising:

a grip body constructed of rigid material formed with a finger rest structure and adapted to be connected to a device operated to produce a recoil force; and a grip insert received and secure by at least on fastener in the grip body and having a resilient deformable backstrap constructed of an elastomeric, shock absorbing and cushioning material adapted to be engaged by a palm of the user's hand minimizing the recoil force caused by operation of the device, wherein the grip body has a curved outer surface formed with the finger rest structure, and a recessed inner surface having a pair of opposed longitudinally extending notches defining a slide track for removably mounting the grip insert therein, the recessed inner surface also having a pair of opposed longitudinally extending and inwardly projecting members configure to secure the at least one fastener, and wherein the backstrap has a spine that extends forwardly therefrom and extends centrally into the recessed inner surface, the spine having a front end connected transversely to a rigid reinforcing member having engagement surfaces being slidably received in the notches, and the spine being slidably received between the inwardly projecting members.

2. The assembly of claim 1, wherein the grip body includes a connector adapted to connect the grip body to the device producing the recoil force.

3. The assembly of claim 1, wherein the rigid reinforcing member has side edges that are matingly received in the slide track of the grip body.

4. A pistol grip recoil assembly for a firearm comprising:

a rigid grip body formed with a finger rest structure thereon, wherein the grip body is configured for connection to the firearm; and a substantially elastomeric, resilient and deformable grin insert received in the grip body forming a shock absorbing, cushioning backstrap engageable with a palm of a user's hand for minimizing recoil caused by discharge of the firearm, wherein the grip body and the grip insert are slidably engaged together by a means of a dovetail arrangement and secured together thereafter by means of a fastening structure, wherein the grip body includes a recessed inner surface formed of the pair of opposed longitudinally extending and inwardly projecting cylindrical tubes provided with holes on bottom ends thereof, and wherein the backstrap includes a base formed with apertures that are alignable with the holes of the cylindrical tubes, the apertures and the holes being configured to receive the fastening structure for securing the grip body and the grip insert together.

5. The assembly of claim 4, wherein the grip body includes a curved forwardly facing outer surface provided with multiple spaced apart ribs that form the finger rest structure therebetween.

6. The assembly of claim 4, wherein the grip body has a top end provided with a connector enabling attachment of the grip body to the firearm.

7. The assembly of claim 4, wherein the grip body has a pair of spaced apart rear walls that are connected together by a bridge portion, and merge smoothly into a bottom end of the grip body.

8. The assembly of claim 4, wherein the inner surface further includes a pair of opposed longitudinally extending notches that define a slide track for receiving the grip insert.

9. The assembly of claim 8, wherein each notch includes a forward segment, a side segment, a rear segment and an angle segment connecting the forward and the side segments.

10. The assembly of claim 9, wherein the backstrap includes an elastomeric spine that is attached to a rigid reinforcing member.

11. The assembly of claim 10, wherein the reinforcing member is constructed of a hard plastic material.

12. The assembly of claim 11, wherein the reinforcing member has opposed side edges, each of which includes a forward wall segment, a side wall segment, a rear wall segment and an angled wall segment connecting the forward wall segment and the side wall segment.

13. The assembly of claim 10, wherein the reinforcing member of the grip insert and the notches of the grip body have cooperating engagement surfaces which define the dovetail arrangement.

14. The assembly of claim 4, wherein the backstrap has a curved outer surface formed with a grip enhancing structure.

15. The assembly of claim 4, wherein the grip insert is removable from the grip body while the grip body is connected to the firearm.

* * * * *